United States Patent [19]

Dawihl et al.

[11] 4,012,824

[45] Mar. 22, 1977

[54] REINFORCED ARTICLE AND METHOD OF MAKING THE SAME

[75] Inventors: Walther Dawihl, Illingen; Gottfried Barthels, Cologne; Gustav Brühn, Opladen; Max Kittendorf, Cologne; Manfred Röper, Leichlingen; Heinz Scheuten, Bensberg-Immekeppel; Oswald Schwerdtfeger, Cologne, all of Germany

[73] Assignee: Felten & Guilleaume Kabelwerke AG, Cologne, Germany

[22] Filed: Jan. 15, 1976

[21] Appl. No.: 649,467

Related U.S. Application Data

[63] Continuation-in-part of Ser. No. 476,287, June 4, 1974, abandoned.

[30] Foreign Application Priority Data

June 6, 1973 Germany ..... 2328774

[52] U.S. Cl. ..... 29/419 R; 264/257; 264/294

[51] Int. Cl.[2] ..... B23P 17/00; B29H 9/02

[58] Field of Search ..... 264/257, 294, 122, 111, 264/109, 248, 250, 258, 262, 271, 268, 319, 345, 320, 322, 331, 332; 29/180 E, 419, 420.5; 156/166, 172, 182, 189, 194, 221, 244, 303.1, 306

[56] References Cited

UNITED STATES PATENTS

| | | | |
|---|---|---|---|
| 2,543,101 | 2/1951 | Francis | 264/257 |
| 3,371,407 | 3/1968 | Forsyth et al. | 29/475 |
| 3,575,767 | 4/1971 | Banks | 156/383 |
| 3,864,807 | 2/1975 | Schneider et al. | 29/419 R |

*Primary Examiner*—Milton S. Mehr
*Attorney, Agent, or Firm*—Michael J. Striker

[57] ABSTRACT

Reinforcing fibers are wound onto a spool together with fibers or strips composed at least in part of a material which is to form a matrix for the reinforcing fibers. The spool is likewise at least partially constituted by such a material. After winding, the resulting assembly is placed into a container having an inner diameter which is the same or slightly larger than the outer diameter of the assembly. The container is also composed at least in part of a material which is to form a matrix for the fibers. The resulting composite blank is then placed in an induction oven and heated to a temperature which does not detrimentally affect the reinforcing fibers but which is sufficient to favorably influence the formation of reaction layers between the reinforcing fibers and the matrix material. The heated blank is compressed so as to remove any air inclusions which may remain in the interior thereof and is simultaneously deformed in a manner which enhances the flow characteristics of the blank during subsequent working. The blank is then extruded so as to form reinforced articles of the desired configuration.

60 Claims, 6 Drawing Figures

REINFORCED ARTICLE AND METHOD OF MAKING THE SAME

CROSS-REFERENCE TO RELATED APPLICATIONS

This is a continuation-in-part application of an application Ser. No. 476,287, filed June 4, 1974, now abandoned.

BACKGROUND OF THE INVENTION

The invention relates generally to reinforced articles and a method of making the same.

Various processes for embedding reinforcing fibers in a matrix material are known.

In this connection, it will be understood that the term "fibers" as used throughout the description and the claims includes wires, filaments, whiskers and the like as well as fibers.

There is already known a process for the production of articles and semi-finished products from composite materials wherein the final composite material consists of a metallic matrix and reinforcing elements in the form of fibers, bands or foils embedded at least at spaced locations throughout the matrix. Here, the reinforcing elements are first coated with the metal which is to form the matrix, and then the cooled elements are arranged on a mold part to form an assembly and the assembly is heated for a short period of time until melting occurs at the points of mutual contact. The heating is effected using conventional electric resistance welding techniques where the electric current directly flows through the assembly. The assembly may be subjected to compression during the heating operation so as to increase the density of the assembly. In addition to this, it is also known to subsequently use extrusion presses for the shaping of the assembly into a composite article, as set forth, for instance, in the German publication 2,147,735.

The known processes, however, possess a rather severe disadvantage. Thus, for the high strength of the reinforcing fibers to be fully utilized, it is necessary to use time-consuming and expensive processing steps, prior to forming the assembly, for coating the reinforcing fibers with the material which is to serve as a matrix in the composite article.

SUMMARY OF THE INVENTION

It is, therefore, a general object of the invention to provide a novel reinforced article and a novel method of making reinforced articles.

Another object of the invention is to provide a method which makes possible to produce reinforced articles more economically than was possible heretofore.

A further object of the invention is to provide a reinforced article which is of lower cost than those known from the art.

An additional object of the invention is to provide a method which permits realization of even larger and more complicated reinforced structural articles than heretofore known.

It is also an object of the invention to provide a method of making reinforced articles which enables uncoated reinforcing elements to be used while, at the same time, permitting full utilization of the inherent strength of the reinforcing elements.

Yet another object of the invention is to provide a method of making reinforced articles which enables the positioning and orientation of the reinforcing elements in the finished articles to be influenced within wide limits.

In pursuance of the foregoing objects, and of others which will become apparent hereafter, the invention provides a method of making reinforced articles which, briefly stated, comprises forming an initial blank member by overlaying at least a portion of a supporting member with reinforcing elements and with matrix-forming elements. The supporting member is composed at least in part of matrix-forming material for the reinforcing elements. A secondary blank member is formed by juxtaposing the initial blank member with another member which surrounds at least a part of the initial blank member and which is composed at least in part of matrix-forming material. The secondary blank member is shaped by extrusion so as to form at least one reinforced article having a desired configuration.

The reinforced elements are advantageously in the form of fibers and much of the discussion herein will be with reference to fiber-reinforced articles. However, it will be appreciated that the principles of the invention may equally apply to reinforcing elements of other configurations such as, for instance, where the reinforcing elements are in the form of bands, strips, foils and the like.

Of interest to the invention, although not exclusively so, is a method for the production of reinforced articles, particularly fiber-reinforced structural articles, wherein the reinforcing elements are positioned on a supporting member or a core together with matrix material to form an assembly and the composite is formed by the application of pressure to the assembly. The method is, with advantage, well-suited for the production of profiled articles of aluminum which are reinforced with steel, carbon or boron elements. Thus, another feature of the invention resides in a method of making reinforced articles wherein an initial blank member is formed by overlaying at least a portion of a supporting member with uncoated reinforcing elements and other elements composed at least in part of matrix-forming material for the reinforcing elements. The supporting member is also at least partially composed of matrix-forming material. A secondary blank member is formed by juxtaposing the initial blank member with another member which at least partially surrounds the initial blank member and which is composed at least in part of matrix-forming material and the secondary blank member is shaped so as to form at least one reinforced article having a desired configuration.

For the sake of simplicity, the elements which are composed at least in part of matrix-forming material and which are used in overlaying the supporting member will be referred to herein as matrix elements. For the same reason, the member with which the initial blank member is juxtaposed to form the secondary blank member will be referred to herein as a cover member although this is not intended to imply that this member need necessarily completely enclose the initial blank member.

The operation of overlaying the supporting member may be accomplished by winding the reinforcing and matrix elements onto the supporting member. The latter may have a spool-shaped configuration and the winding operation may entail coiling of the reinforcing and matrix elements on the supporting member. The winding operation may further entail tensioning the reinforcing and matrix elements so that they are wound onto the supporting member under tension. Advantageously, the reinforcing elements are subjected to a cleaning operation before being wound onto the supporting member.

According to a favorable embodiment of the invention, the cover member is configurated as a cup-shaped container having an open end. In this event, the secondary blank may be formed by inserting the initial blank into the container via its open end.

It is of advantage when the secondary blank is heated prior to being shaped and the heating is preferably carried out in an induction oven. It is of further advantage when, subsequent to being heated but before being shaped, the secondary blank is subjected to compression in a suitable press. This compression, which may be carried out while the secondary blank is still warm, is favorably performed in such a manner that the secondary blank undergoes a deformation which enhances the flow characteristics thereof during the subsequent shaping operation. The latter may entail admitting the secondary blank into an extrusion press and extruding it to the desired configuration. If compression of the secondary blank is performed while the latter is still warm, then, in accordance with one embodiment of the invention, the secondary blank is subjected to controlled cooling after compression and before shaping in order to enhance the properties of the matrix material and/or the material of the reinforcing elements.

It is advantageous for the secondary blank to be treated in a manner which enhances the formation of reaction layers between the material of the reinforcing elements and adjacent matrix-forming material, and one manner of effecting such enhancement is by heating the secondary blank prior to shaping. It is further favorable when air inclusions which may remain in the secondary blank are removed therefrom prior to the shaping operation and this may be at least partially effected by subjecting the secondary blank to compression after heating. Air inclusions may also be eliminated, or at least minimized, by subjecting the secondary blank to a cold compression prior to heating.

Similarly to the reinforcing elements, the matrix elements may be in the form of fibers. However, the matrix elements may also be in the form of bands, strips, foils and the like. According to one embodiment of the invention, the matrix elements comprise reinforcing fibers which are coated with matrix-forming material.

In connection with the air inclusions referred to above, it is to be mentioned that such inclusions may be further minimized when the reinforcing and/or matrix elements are of non-circular cross sections. According to a particularly favorable embodiment of the invention, at least some of the matrix elements may be of substantially strip-shaped configurations or may have the form of sheets.

In accordance with the invention, it is possible to wind reinforcing elements about the matrix elements and to then wind the resulting composites onto the supporting member. In this manner, a web-like arrangement may be obtained in the finished article, for example, a web-like fiber arrangement when the reinforcing elements are in the form of fibers. The reinforcing elements and matrix elements may also be intertwined so as to form strands which are then wound onto the supporting member, and such strands are advantageously subjected to compression in a suitable die or the like prior to winding, it being particularly favorable when the compression is performed in such a manner as to impart a non-circular cross-section to the strands prior to winding since this serves to further minimize air inclusions in the primary and secondary blank.

The winding of the reinforcing and matrix elements and/or of the strands formed by intertwining the same way be effected in such a manner that the reinforcing and matrix elements and/or the strands are arranged in layers on the supporting member. It is of advantage here for the winding operation to entail coiling of the reinforcing and matrix elements and/or the strands on the supporting member and for the winding operation to be carried out in such a manner that adjacent layers extend crosswise to one another and/or the direction of coiling is different for adjacent layers. According to one embodiment of the invention, the reinforcing elements and the matrix elements are separately arranged in different layers.

In order to obtain a uniform distribution of reinforcing elements in the finished article, that is, to obtain uniform reinforcement of the finished article, it is possible to provide for a supporting element which is formed of reinforced matrix material or, in other words, a matrix material which is itself already reinforced with reinforcing elements. Furthermore, it is sometimes desirable for the outer surface of the finished article to possess certain predetermined characteristics and, for this purpose, it is possible for the cover member, which determines the properties of the outermost layer of the article, to be composed of a different material than the supporting member and the matrix elements.

The method of the invention is also suitable for the production of hollow, profiled reinforced articles such as, for instance, tubes, pipes and the like. In such an event, the supporting member may be provided with a passage of predetermined configuration and a shaft of this configuration is inserted in the passage prior to the shaping operation so that this operation results in a hollow article of the desired configuration once the shaft has been removed. Here, it may be desirable for the inner surface of the finished article to have certain predetermined characteristics and, in such cases, the supporting member, which determines the properties of the innermost layer of the article, may be composed of a material which is different from that of the matrix elements.

It will be appreciated from the above that several possibilities exist as regards the matrix-forming material of the various components, that is the supporting member, the cover member and the matrix elements. Thus, the matrix-forming material may be different for each of these components, or two of these components may include the same matrix-forming material, with the remaining component comprising a different matrix-forming material. On the other hand, it is also possible for the supporting member, the cover member and the matrix elements to include the same matrix-forming material.

The invention is suitable for use in the production of reinforced articles from both metallic and non-metallic matrix-forming materials. Likewise, the reinforcing elements may be metallic or non-metallic. A particularly favorable combination resides in the use of aluminum as a matrix-forming material and high-strength steel or carbon reinforcing elements, especially high-strength steel fibers or endless carbon fibers.

Among the advantages achievable with the invention, it may be mentioned that the method of the invention makes it possible to produce high-strength structural articles containing virtually any desired matrix material using conventional apparatus and preferably using uncoated, that is, inexpensive, reinforcing elements. The adhesion between the reinforcing and matrix materials which results from the treatment of the secondary blank is so strong that the highly complex and expensive techniques for coating the reinforcing elements may be eliminated. Moreover, the widespread belief in the art that composite coiled blanks of the type here under consideration, particularly those wound with high-strength steel fibers, cannot be extruded in an extrusion press is disproved by the invention. Experience with the present invention shows that numerous matrix-forming materials act as lubricants for the coils of reinforcing fibers during extrusion of the blank under the pressure and temperature conditions existing in the extrusion press.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
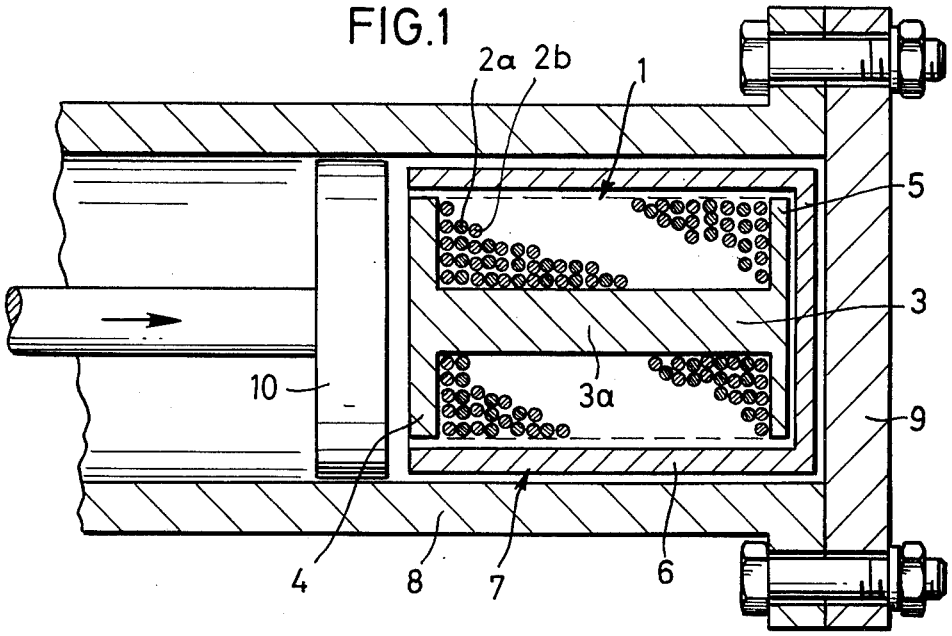
FIG. 1 is a simplified sectional view of a press and first embodiment of a secondary blank which is to be compressed thereby.

Referring now to the drawing, and first to FIG. 1, it may be seen that the reference numeral 3 represents a supporting member of spool-shaped configuration which has a solid core 3*a* and flanges 4 and 5 connected thereto. The supporting member 3 is at least partially constituted by a material which is to form part of the matrix of a reinforced article. The supporting member 3 is wound or coiled with reinforcing fibers 2*a* and matrix fibers 2*b*, that is, fibers which are at least in part composed of a material which is to form part of the matrix of a reinforced article. The supporting member 3 with its windings of uncoated reinforcing fibers 2*a* and matrix fibers 2*b* constitutes an initial blank member 1.

In order to prepare the initial blank member 1, the reinforcing fibers 2*a* may, together with the matrix fibers 2*b*, be withdrawn from suitable supply reels which are entirely conventional and have not been illustrated. The reinforcing fibers 2*a* and the matrix fibers 2*b* may then be passed through one or more liquid baths in order to free them from adherent impurities and may thereafter be further cleaned or purified by means of stripping or wiping devices and/or by subjecting them to heating. Immediately following the latter cleaning operation, the reinforcing fibers 2*a* and the matrix fibers 2*b* are wound or coiled onto the supporting member 3, on the core 3*a* thereof, preferably under tension. The supporting member 3 is wound until the height of the windings formed by the reinforcing fibers 2*a* and the matrix fibers 2*b* substantially corresponds to the height of the flanges 4 and 5 of the supporting member 3.

The thus-formed initial blank 1 is then placed inside a member 6 so as to form a secondary blank member 7 which, in the present instance, is constituted by the member 6, the supporting member 3 and the windings of reinforcing fibers 2*a* and matrix fibers 2*b*. The member 6 is here illustrated as having the configuration of a container or as having a cup-shaped configuration, and the inner diameter of the member 6 substantially corresponds to the outer diameter of the flanges 4 and 5 of the supporting member 3. The member 6 is also constituted at least in part by a material which is to form part of the matrix of a reinforced article, for example, aluminum. In order to avoid the presence of inhomogeneities in articles, such as structural reinforced articles which are to be subsequently produced therefrom, the member 6 is advantageously constructed of one piece, that is, the member 6 is advantageously formed by deep or shallow drawing, by machining out of a solid body of material or by similar procedures.

The secondary blank 7 is placed in an induction oven and heated to a temperature which does not detrimentally affect the strength characteristics of the reinforcing fibers 2*a* but which is sufficiently high to favor the formation of reaction layers between the material of the reinforcing fibers 2*a* and the matrix-forming material during subsequent compression. The magnitude of such temperature depends on the material of the reinforcing fibers 2*a* and will be selected in view of the properties of the reinforcing material, taking into consideration the interaction of such material with the matrix-forming material. Inasmuch as such materials and their properties and interreactions are known and easily ascertainable, it is not necessary to elaborate thereon.

After the heat treatment and while still warm, the secondary blank 7 is placed in a conventional press indicated at 8, 9 and 10 and is subjected to pressure therein. During this compression, air which may be present in the secondary blank 7 in form of inclusions is permitted to escape through interfaces between the members 3 and 6 and further through interfaces or gaps between the parts 8 and 10 of the press. In order to enhance the escape of the air from the secondary blank 7, the internal chamber of the press 8, 9 and 10, in which the secondary blank 7 is accommodated, may be subjected to subatmospheric pressure. In addition, the secondary blank 7 may be deformed in the press 8, 9 and 10 in a manner which enhances the flow characteristics of the secondary blank 7 during a subsequent operation in which a flow of the material of the secondary blank 7 is to occur, that is, a shaping or extrusion operation. In the present instance, it is assumed that the secondary blank 7 is subjected to a cylindrical deformation in the press 8, 9 and 10.

Figure 2:
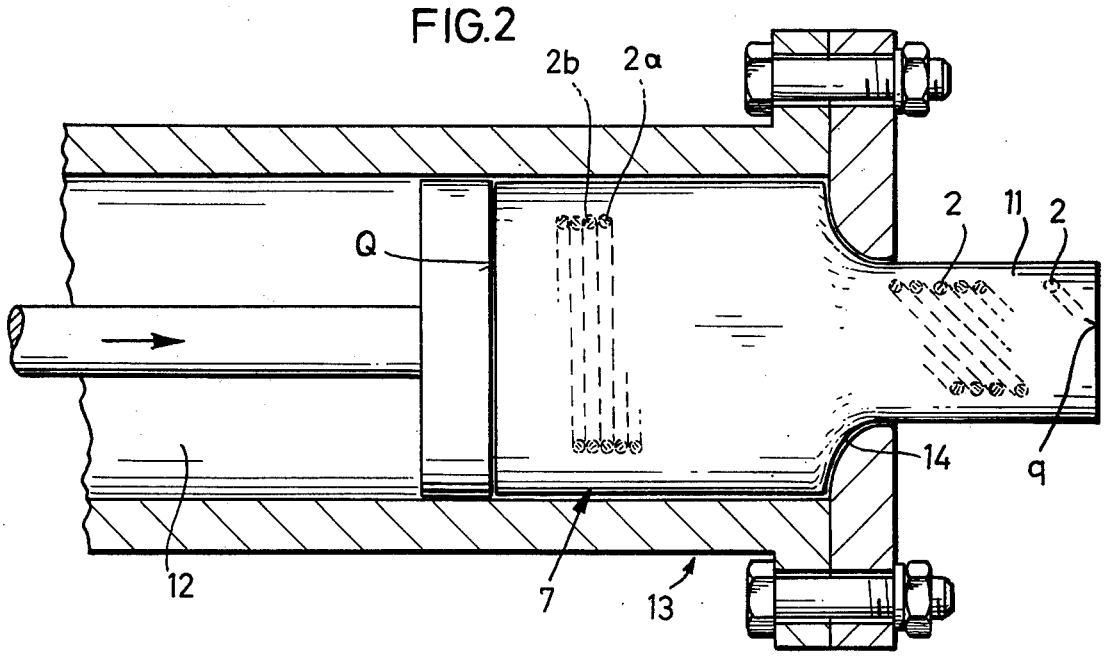
FIG. 2 is a sectional view of a part of an extrusion press which illustrates one manner of extruding the secondary blank of FIG. 1.
Figure 3:
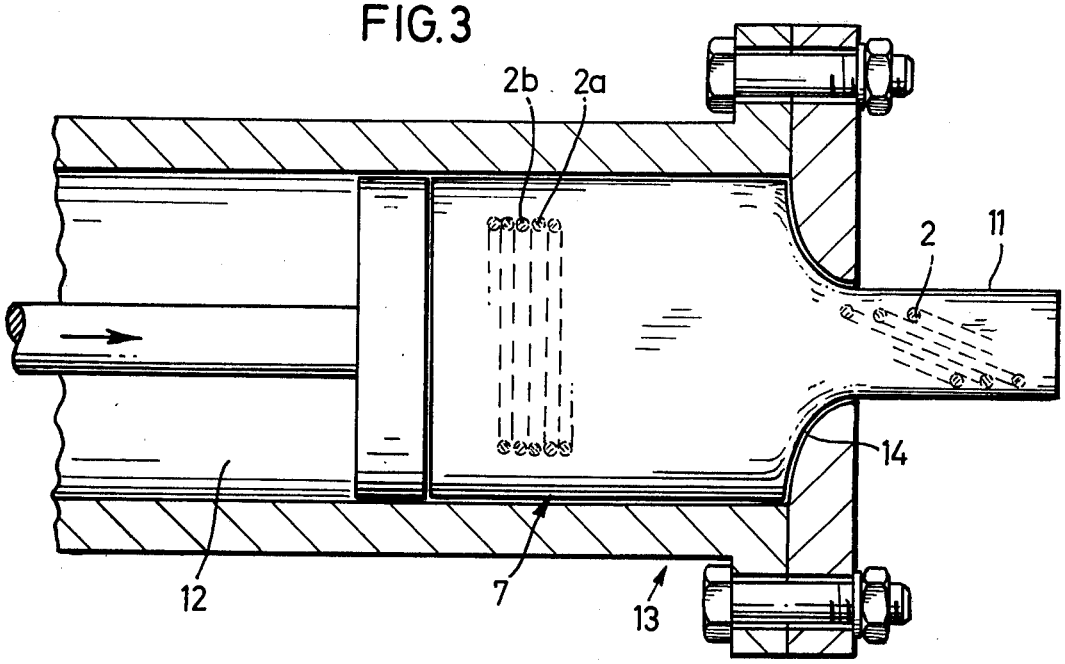
FIG. 3 is a view similar to FIG. 2 but illustrating a different manner of extruding the secondary blank of FIG. 1.

Referring now to FIGS. 2 and 3, the compressed secondary blank 7 is then placed in an extrusion press 13 and is extruded therein to produce a finished, reinforced article 11 having a desired configuration. The extrusion press 13 is of a conventional construction, such press 13 being well known for extruding aticles which are either not reinforced, or reinforced in such a manner that the matrix material is introduced by coating the reinforcing elements therewith prior to shaping the composite elements into the blank which is to be extruded. Therefore, the details of the extrusion press 13 itself are not explained, particularly inasmuch as extrusion presses of different constructions may be employed in the extrusion operation. It is sufficient to say, for understanding the method of the present invention, that the extrusion operation involves pressing the secondary blank 7 through an orifice 14 of a shape which corresponds to the desired shape of the finished article 11, taking into consideration elastic deformation of the material of the secondary blank 7 which results in a slight increase in the dimensions of the article 11 upon passing through the orifice 14. The extrusion operation involves, in many instances, severe plastic deformation of the material of the secondary blank 7 which has a cross-sectional area Q, for the material to squeeze through the orifice 14 of a cross-sectional area $q$. Therefore, the matrix-forming material must have a rather high degree of ductility, at least under the temperature and pressure conditions prevailing in the extrusion press 13. However, since the present invention is not concerned with the particular extrusion press used for the extrusion operation, such press being entirely conventional, the press is illustrated only in a diagrammatic manner and it is to be understood that the details of the extrusion press 13 in actual use may vary from those illustrated.

Of course, it is also possible to shape the secondary blank 7 by other means. For instance, it is possible to provide a mold having a configuration corresponding to the desired configuration of the reinforced article to be produced and to shape the secondary blank 7 in a suitable press using this mold.

The orientation of the reinforcing fibers 2*a* in the shaped article 11, when using the method according to the invention, may be selected by the manner in which these are wound onto the supporting member 3 and/or by the ratio of the cross-section Q of the secondary blank 7, which substantially corresponds to that of the inlet end 12 of the extruder 13, to the cross-section $q$ of the shaped article 11.

When the reinforcing fibers 2*a* are wound onto the supporting member 3 in such a manner that the convolutions thereof are arranged substantially normal to the axial direction of the core part of the supporting member 3, that is, the part of the latter extending between the flanges 4 and 5 thereof, and when the secondary blank 7 is inserted into the extruder 13 in such a manner that the axial direction of the core 3*a* of the supporting member 3 substantially coincides with the longitudinal axis of the shaped article 11, as proposed by the present invention, then the reinforcing fibers 2*a* or the convolutions thereof will, in the shaped article 11, remain oriented substantially normal to the longitudinal axis of the latter when the ratio Q:$q$ is only slightly smaller than 1:1. This is due to the fact that the secondary blank 7 is subjected to only a minimum deformation which does not result in reorientation of the fibers 2*a*. When the ratio Q:$q$ lies between about 2:1 and 5:1, the reinforcing fibers 2*a* will extend substantially helically along the longitudinal axis of the shaped article 11, as diagrammatically illustrated in FIG. 2. When the ratio Q:$q$ is greater than about 5:1, the reinforcing fibers 2*a* will extend substantially parallel to the longitudinal axis of the shaped article 11, and this is schematically shown in FIG. 3. The deformation of the secondary blank 7, under these circumstances, is so severe that it results in a substantially complete reorientation of the fibers 2*a*.

Thus, it will be appreciated that, in general, the pitch and/or the diameter of the convolutions of the reinforcing fibers 2*a* in the shaped article 11 as opposed to the pitch and/or the diameter thereof prior to the shaping operation will vary in dependence upon the ratio Q:$q$.

Figure 4:
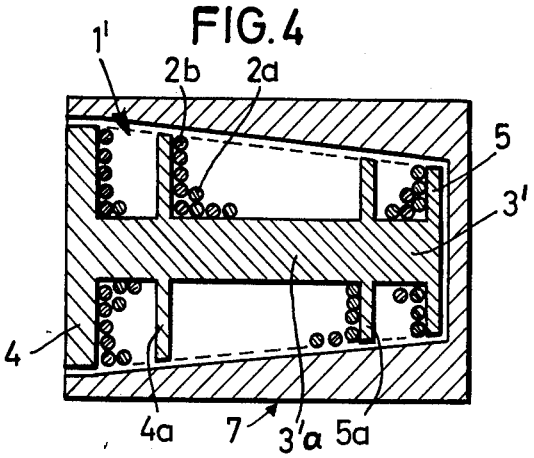
FIG. 4 is a simplified sectional view of a second embodiment of a secondary blank.

Depending upon the intended application of the shaped article 11, it may be advantageous to use high-strength steel fibers, especially high-strength steel wires, for the reinforcing fibers 2*a* or to use carbon or boron fibers, especially endless carbon filaments, for the reinforcing fibers 2*a*. If it is desired for the proportion of reinforcing material in the shaped article 11 to be particularly high, then, instead of using solely matrix fibers 26 which are constituted solely by matrix-forming material, it is of advantage when some or all of the matrix fibers 2*b* are in the form of reinforcing fibers 2*a* which are coated with matrix-forming material prior to winding them onto the core 3*a*. However, since the secondary blank 7 includes other fibers in addition to the coated reinforcing fibers 2*a*, it is not necessary to coat the fibers 2*a* using complex coating procedures, particularly inasmuch as the permanent bond between the reinforcing and matrix-forming material is obtained during shaping of the secondary blank 7. Furthermore, if it is desired for the shaped article 11 to have a layered configuration wherein alternate layers comprise high proportions of reinforcing material and the remaining layers comprise substantially pure matrix material or matrix material having a low proportion of reinforcing material, which may, in particular, be desired for hollow, profiled articles, then it is advantageous for the reinforcing fibers 2*a* and the matrix fibers 2*b* to be wound onto the supporting member 3 in the form of layers with the reinforcing fibers 2*a* and the matrix fibers 2*b* being arranged separately in different layers. In such an event, one or more of the layers of the matrix fibers 2*b* may favorably be replaced by sheets or strips of matrix-forming material which are placed about the core part of the supporting member 3 and extend circumferentially thereof. The sheets of matrix-forming material may also be in the form of tubular members. Furthermore, discs 4*a*, 5*a*, may have outer diameters substantially corresponding to those of the flanges 4 and 5 of the supporting member 3′ and one or more of such discs 4*a*, 5*a* may be either formed on the core 3*a*′ of the supporting member 3 at spaced locations therealong during the forming of the member 3, or may be mounted on the core part 3*a* of the supporting member 3 before attaching a separate flange 4 thereto. However, as illustrated in FIG. 4 the diameters of the discs 4*a* and 5*a* may also decrease from a larger flange 4 to a smaller flange 5 so that the primary blank 1 will have a frusto-conical configuration. After that, the spaces between adjacent discs 4*a*, 5*a* and the discs 4*a* and 5*a* and the flanges 4 and 5 may successively or simultaneously be filled with the reinforcing fibers 2*a* by winding the latter into these spaces. If particularly high proportions of reinforcing material are desired in the shaped article 11, then, instead of using fibers 2b or sheets for the matrix elements which are composed essentially of matrix-forming material, it is possible to use fibers or sheets composed of matrix-forming material which is already reinforced, for instance, by fibers 2a. There again, the coating procedure need not result in a permanent bond between the reinforcing and matrix-forming material.

It is further possible to wind or coil the reinforcing fibers 2a about the matrix fibers or sheets 2b prior to winding them onto the supporting member 3 to thereby obtain the primary blank member 1. In such an event, a web-like fiber arrangement in achieved in the shaped article 11.

Coiled blanks 7 of the type described until now will always contain a certain amount of air inclusions since, by virtue of the round or, at least, rounded, cross-sections of the reinforcing fibers 2a, these will not be in contact with the matrix-forming material over their entire surface area. The air inclusions may cause a certain porosity to exist in the shaped article 11. A reduction in the number of air inclusions is already achieved when the matrix fibers 2b are of non-circular cross sections, that is, for example, when the matrix fibers 2b have a square, a rectangular or a hexagonal cross-section. A further reduction in the number of air inclusions may be realized when, prior to winding the supporting member 3, the reinforcing fibers 2a are intertwined with matrix fibers 2b so as to form one or more strands. This is particularly so when the thus-formed strands are subjected to compression in a mold or die prior to winding the same onto the supporting member 3 and especially when the strands are deformed in the mold or die so as to impart to them a non-circular cross-section such as, for instance, a square, a rectangular or a hexagonal cross-section.

A particularly favorable arrangement of the reinforcing fibers 1 in the shaped article 11, especially when the latter is in the form of a hollow, profiled article, is obtained when the reinforcing fibers 2a and the matrix fibers 2b, or the strands formed by intertwining the reinforcing fibers 2a and the matrix fibers 2b, are wound onto the supporting member 3 in layers with adjacent ones of the layers extending crosswise to one another and/or with the direction of coiling being different for adjacent layers. By proceeding in this manner, there is obtained in the shaped article 11 a plurality of interpenetrating layers of reinforcing fibers 2a which are arranged in a spiral of helical fashion with the convolutions of the individual layers having opposing coiling directions. This arrangement of the reinforcing material opposes the tendency of the shaped article 11 to deform torsionally within itself when it is subjected to loading.

Under certain circumstances, it is advantageous to subject the wound supporting member 3 or the secondary blank 7 to a cold pre-compression in a press prior to the introduction thereof into the induction oven. In this manner, the air inclusions may already be eliminated or, at least, reduced in number, prior to the heating operation.

When using certain materials, particularly when high-strength steel is used for the reinforcing fibers 2a and aluminum is used as a matrix-forming material, it is of advantage to subject the secondary blank 7, which has been compressed while still warm, to controlled cooling prior to shaping the same in the extrusion press 13. In this manner, it is possible to improve the strength properties of these materials in the shaped article 11 as well as to improve the flow characteristics of the secondary blank 7 during the operation in the extrusion press. Moreover, the formation of reaction layers between the reinforcing material and the matrix-forming material, which plays an important role as regards the adhesion of the reinforcing fibers 2a in the matrix material, may be substantially influenced by such a controlled cooling procedure. Of course, the particular manner in which the cooling is effected will depend on the particular materials involved.

If it is desired to have a particularly high content of reinforcing fibers 2a in the shaped article 11, especially in the interior thereof, then it is advantageous when the supporting member 3 or, at least, the core 3a thereof, is formed of reinforced matrix-forming material such as fiber-reinforced matrix-forming material.

If the outer surface of the shaped article 11 is to possess predetermined characteristics which cannot be obtained with the selected matrix material, then it is possible, in accordance with the invention, for the member 6 which surrounds the primary blank 1 to be composed of a material which is different from that of the supporting member 3 and the matrix fibers 2b in order to achieve such outer surface characteristics. In this manner, it becomes possible, for instance, to produce copper coated or plated, fiber-reinforced aluminum profiles or tubes.

Figure 5:
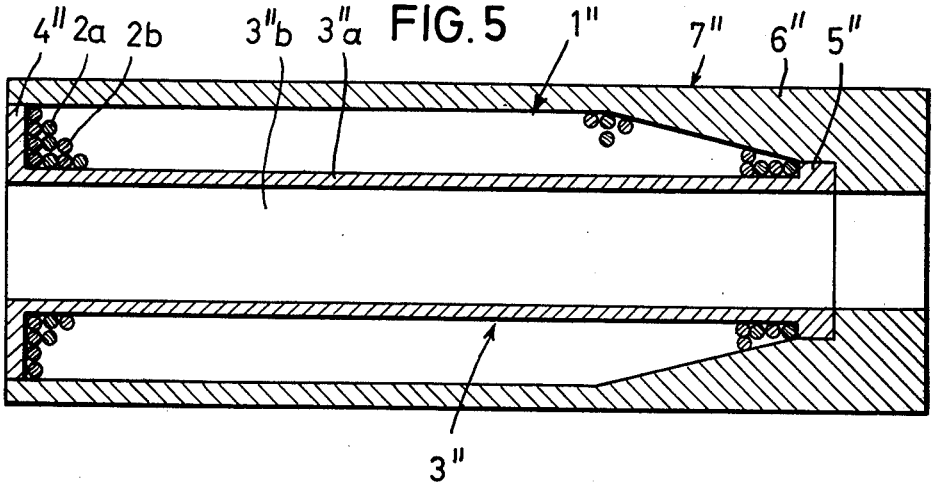
FIG. 5 is a simplified sectional view of a third embodiment of a secondary blank.

FIG. 5 illustrates another embodiment of a secondary blank 7'' composed of a primary blank 1'' which, in this embodiment, has a core 3a'' which is formed with a passage 3b''. This embodiment is particularly suited for extruding hollow articles 11, such as pipes and the like. A larger flange 4'' and a smaller flange 5'' extend radially of the core 3a'', and the matrix-forming fibers 2b and the reinforcing fibers 2a are coiled on the core 3a'' of a supporting member 3'' to assume a frusto-conical configuration between the flanges 4'' and 5''. As illustrated, only a part of the coiled body of the fibers 2a and 3a is frusto-conical, the remainder of the body being cylindrical. However, the entire body of the fibers 2a and 2b may be frusto-conical if so desired. A cup-shaped member 6'' surrounds the primary blank member 1'' and is internally so configurated that the primary blank member 1'' can be accommodated therein without excessive play, preferably snugly.

Figure 6:
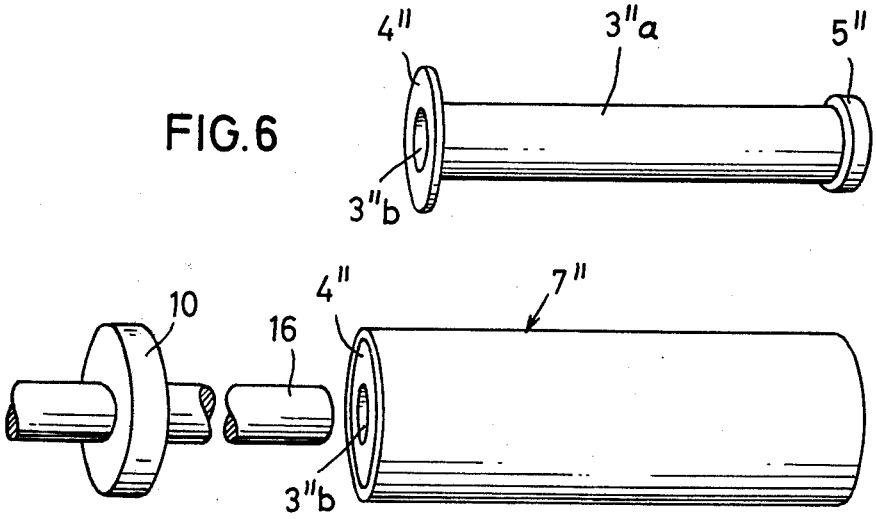
FIG. 6 is a view similar to FIG. 2 but illustrating extrusion of a secondary blank into a tubular article.

If hollow, profiled, reinforced articles such as, for example, tubes, pipes and the like, are to be produced with the method according to the invention, then the reinforcing fibers 2a and the matrix fibers 2b are wound onto a supporting member configurated like the hollow supporting member 3'' illustrated in FIG. 5, that is, a supporting member having a core 3a'' provided with a passage 3b. The passage 3b'', as illustrated in FIG. 6, fits, after compression, onto a shaft 16 inserted into the extrusion press 13 and having a configuration which corresponds to the desired inner profile to be obtained. In this application of the method according to the invention, it is also possible to line the passage 3b of the supporting member 3' or 3'' with a material different from the matrix-forming material of the supporting member 3'', the member 6 which surrounds the latter, and the matrix fibers 2b, or to form the entire supporting member 3'' of a material which is different from that of the matrix fibers 2b. In this manner, it becomes possible, for example, to produce fiber-reinforced aluminum tubes which are copper coated both interiorly and exteriorly.

The secondary blank 7'' illustrated in FIG. 6 is already compressed so that it presents a composite body which is pressed through the orifice 14 of the extrusion press 13 around the shaft 16. It will be appreciated that a similar result can be obtained using the embodiments of the secondary blank 7 or 7' illustrated in FIGS. 1 to 4, in which event the interiors of the cores 3*a* or 3*a*' will be provided with passages resembling the passage 3*b*'' of FIG. 5.

The matrix-forming material of the cup-shaped member 6, 6' or 6'', in addition to confining the primary blank member 1, 1' or 1'', also serves the purpose of enhancing the flow of the composite material through the orifice 14 of the extrusion press. This is due to the fact that the material of the member 6, 6' or 6'' has a higher overall ductility than the composite material of the primary blank 1, 1' or 1''. A similar consideration is also valid in connection with the hollow supporting member 3, 3' or 3'' with respect to flow of the material about the shaft 16 associated with the extrusion press 13.

It will be understood that each of the elements described above, or two or more together, may also find a useful application in other types of methods and articles.

While the invention has been illustrated and described as embodied in a reinforced article and method of making the same, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applicatons without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A method of making an elongated article which is reinforced by elements arranged about a longitudinal axis of the article, comprising the steps of providing a supporting member substantially of matrix-forming material; overlaying at least a portion of the supporting member with reinforcing elements and other elements composed at least in part of matrix-forming material for the reinforcing elements to thereby form a primary blank member which has an axis and in which the elements are arranged around said axis; forming a secondary blank member by coaxially accommodating said primary blank member within another member which is at least in part composed of matrix-forming material; and applying pressure to said secondary blank member radially of the same so as to deform the secondary blank member into the reinforced article having a desired configuration and desired orientation of the reinforcing elements about the longitudinal axis.

2. A method as defined in claim 1, wherein said pressure-applying step includes extrusion of the secondary blank axially thereof.

3. A method as defined in claim 1; and further comprising the step of heating said secondary blank member prior to said pressure-applying step.

4. A method as defined in claim 3, wherein said heating is performed in an induction oven.

5. A method as defined in claim 3; and further comprising the step of subjecting said secondary blank member to compression prior to said heating step.

6. A method as defined in claim 2; and further comprising the step of subjecting said secondary blank member to compression subsequent to said heating step and prior to said pressure-applying step.

7. A method as defined in claim 6, wherein said compression is effected prior to cooling of said secondary blank member; and further comprising the step of subjecting said secondary blank member to controlled cooling prior to said pressure-applying step so as to improve the flow characteristics of said secondary blank member during said pressure-applying step and so as to improve the properties of said reinforced article.

8. A method as defined in claim 1; and further comprising the step of removing air inclusions from said secondary blank member.

9. A method as defined in claim 1; and further comprising the step of treating said secondary blank member so as to enhance the formation of reaction layers between the material of said reinforcing elements and adjacent matrix-forming material.

10. A method as defined in claim 1; and further comprising the step of deforming said secondary blank member prior to said shaping so as to enhance the flow characteristics of said secondary blank member during said pressure-applying step.

11. A method as defined in claim 10, wherein said deforming step includes subjecting said secondary blank member to compression so as to remove air inclusions from said secondary blank member.

12. A method as defined in claim 1; and further comprising the step of cleaning said reinforcing elements prior to said overlaying step.

13. A method as defined in claim 1, wherein said reinforcing elements include fibers.

14. A method as defined in claim 1, wherein said other elements include fibers.

15. A method as defined in claim 1, wherein said overlaying step includes winding the reinforcing elements onto the supporting member.

16. A method as defined in claim 15, wherein said winding includes coiling the reinforcing elements on the supporting member.

17. A method as defined in claim 1, wherein said overlaying step includes winding the other elements onto the supporting member.

18. A method as defined in claim 17, wherein said winding includes coiling the other elements on the supporting member.

19. A method as defined in claim 1, wherein the supporting member is of substantially spool-shaped configuration; and wherein said overlaying step includes winding the elements onto the supporting member.

20. A method as defined in claim 1, and further comprising the step of subjecting said elements to tension during said overlaying step.

21. A method as defined in claim 1, wherein said other member is configurated as a container having an open end; and wherein said accommodating step includes inserting said primary blank member into said other member through said open end.

22. A method as defined in claim 1, wherein the matrix-forming material of at least one of the supporting members, the other elements and the other member is metallic.

23. A method as defined in claim 22, wherein said metallic matrix-forming material includes aluminum.

24. A method as defined in claim 1, wherein the supporting member, the other elements and the other member comprise different matrix-forming materials.

25. A method as defined in claim 1, wherein one of the supporting members, the other elements and the other member comprises a different matrix-forming material than the others.

26. A method as defined in claim 25, wherein the other member is composed of a different material than the supporting member and the other elements to thereby impart predetermined characteristics to the outer surface of the reinforced article.

27. A method as defined in claim 1, wherein the supporting member, the other elements and the other member include the same matrix-forming material.

28. A method as defined in claim 1, wherein said reinforcing elements are metallic.

29. A method as defined in claim 28, wherein said metallic reinforcing elements are of high-strength steel.

30. A method as defined in claim 1, wherein said reinforcing elements are of carbon.

31. A method as defined in claim 30, wherein said carbon reinforcing elements are endless carbon fibers.

32. A method as defined in claim 1, wherein said overlaying step includes arranging the elements in layers.

33. A method as defined in claim 32, wherein the reinforcing elements and the other elements are arranged in different layers.

34. A method as defined in claim 32, said overlaying step including coiling the elements onto the supporting member; and wherein the direction of coiling is different for superimposed layers.

35. A method as defined in claim 34, wherein the superimposed layers extend crosswise to one another.

36. A method as defined in claim 32, wherein superimposed layers extend crosswise to one another.

37. A method as defined in claim 1; and further comprising the step of intertwining at least some of the reinforcing elements with at least some of the other elements prior to said overlaying step so as to form at least one strand.

38. A method as defined in claim 37, said intertwining step including forming a plurality of strands; and wherein said overlaying comprises arranging the strands in layers on said supporting member.

39. A method as defined in claim 38, said overlaying step comprising coiling the strands onto the supporting member; and wherein the direction of coiling is different for superimposed layers.

40. A method as defined in claim 39, wherein the superimposed layers extend crosswise to one another.

41. A method as defined in claim 38, wherein superimposed layers extend crosswise to one another.

42. A method as defined in claim 27; and further comprising the step of subjecting the strand to compression prior to said overlaying step.

43. A method as defined in claim 42, wherein said compression comprises deforming the strand so as to impart thereto a non-circular cross-section.

44. A method as defined in claim 1, wherein at least some of the elements are of non-circular cross sections so as to permit a more compact arrangement of said elements on said supporting member.

45. A method as defined in claim 1, wherein at least some of the other elements are in the form of sheets.

46. A method as defined in claim 1; and further comprising the step of winding at least some of the reinforcing elements about at least some of the other elements prior to said overlaying step so as to produce a web-like arrangement of the elements in the reinforced article.

47. A method as defined in claim 1, the reinforcing elements comprising fibers; and wherein the other elements are fiber elements provided with a coating of matrix-forming material.

48. A method as defined in claim 2, the reinforced article having an axis and a first cross-sectional area in a plane normal to the axis; the secondary blank having a second cross-sectional area in a plane normal to the axis; wherein said overlaying step includes orienting said reinforcing elements substantially normal to the axis; and wherein said extruding step results in reorientation of said reinforcing elements in the reinforced article in dependence upon the ratio of said second cross-section to said first cross-section.

49. A method as defined in claim 48, wherein said ratio is approximately 1:1 whereby the orientation of the reinforcing elements in the reinforced article is such that the reinforcing elements extend substantially normal to said axis.

50. A method as defined in claim 48, wherein said ratio is between substantially 2:1 and 5:1 whereby the orientation of the reinforcing elements in the reinforced article is such that the reinforcing elements extend substantially helically along said axis.

51. A method as defined in claim 48, wherein said ratio is greater than about 5:1 whereby the orientation of the reinforcing elements in the reinforced article is such that the reinforcing elements extend substantially parallel to said axis.

52. A method as defined in claim 1, wherein the supporting member comprises matrix-forming material reinforced with components similar to the reinforcing elements so as to obtain substantially uniform reinforcement of the reinforced article.

53. A method as defined in claim 1, said supporting member being provided with a passage of predetermined configuration; and further comprising the step of inserting a shaft of said predetermined configuration in said passage prior to said pressure-applying step so that said one reinforced article is of hollow, profiled configuration.

54. A method as defined in claim 53, wherein the reinforced article is a tube.

55. A method as defined in claim 53, wherein the supporting member is composed of a different material than the other elements so as to impart predetermined characteristics to the inner surface of the reinforced article.

56. A reinforced article produced according to the method of claim 1.

57. A method of making reinforced articles, comprising the steps of forming a primary blank member by overlaying at least one portion of a supporting member with uncoated reinforcing elements, said supporting member being composed at least in part of matrix-forming material for said elements; forming a secondary blank member by juxtaposing said primary blank member with another member which at least partially surrounds said initial blank member and which is composed at least in part of matrix-forming material; and applying pressure to said secondary blank member so as to form at least one reinforced article having a desired configuration.

58. A method as defined in claim 57, wherein said pressure-applying step includes extrusion.

59. A method as defined in claim 57, wherein said primary blank is at least partially of frusto-conical configuration; wherein said other member is formed with an internal chamber of frusto-conical configuration; and wherein said accommodating step involves inserting said primary blank into said chamber so that said primary blank is fittingly received in said chamber.

60. A method as defined in claim 57, wherein said step of forming the primary blank member includes forming the supporting member with a core having an axis and a plurality of spaced disc-shaped elements extending radially outwardly of the core; and wherein said overlaying step includes winding the reinforcing elements into spaces between said disc-shaped elements.

* * * * *